US007854770B2

(12) United States Patent
Du et al.

(10) Patent No.: US 7,854,770 B2
(45) Date of Patent: Dec. 21, 2010

(54) DETERGENT COMPOSITION COMPRISING A SURFACTANT SYSTEM AND A PYROPHOSPHATE

(75) Inventors: Junhua Du, Beijing (CN); Qing Chen, Beijing (CN); Li Ran, Beijing (CN); Ignacio Gallo-Perez, Cullercoats (GB); Ming Tang, Beijing (CN); Kenneth Nathan Price, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 12/276,638

(22) Filed: Nov. 24, 2008

(65) Prior Publication Data

US 2009/0143269 A1 Jun. 4, 2009

(30) Foreign Application Priority Data

Dec. 4, 2007 (EP) ..... 07122319

(51) Int. Cl.

| | |
|---|---|
| ***B08B 3/04*** | (2006.01) |
| ***C11D 1/14*** | (2006.01) |
| ***C11D 1/22*** | (2006.01) |
| ***C11D 3/08*** | (2006.01) |
| ***C11D 9/14*** | (2006.01) |

(52) U.S. Cl. ..... 8/137; 510/276; 510/467; 510/475; 510/531; 510/534

(58) Field of Classification Search ..... 510/276, 510/467, 475, 531, 534; 8/137
See application file for complete search history.

(56) References Cited

U.S. PATENT DOCUMENTS

| | | | | |
|---|---|---|---|---|
| 3,473,889 | A | 10/1969 | Shen | |
| 4,000,093 | A | 12/1976 | Nicol et al. | |
| 4,153,569 | A * | 5/1979 | Van Den Brom | 510/425 |
| 4,228,042 | A | 10/1980 | Letton | |
| 4,239,660 | A | 12/1980 | Kingry | |
| 4,260,529 | A | 4/1981 | Letton | |
| 4,430,243 | A | 2/1984 | Bragg | |
| 4,483,779 | A | 11/1984 | Llenado | |
| 4,483,780 | A | 11/1984 | Llenado | |
| 4,762,636 | A | 8/1988 | Balliello et al. | |
| 4,990,280 | A | 2/1991 | Thorengaard et al. | |
| 4,565,647 | A | 4/1994 | Llenado | |
| 5,332,528 | A | 7/1994 | Pan et al. | |
| 5,486,303 | A | 1/1996 | Capeci et al. | |
| 5,489,392 | A | 2/1996 | Capeci et al. | |
| 5,516,448 | A | 5/1996 | Capeci et al. | |
| 5,565,422 | A | 10/1996 | Del Greco et al. | |
| 5,569,645 | A | 10/1996 | Dinniwell et al. | |
| 5,574,005 | A | 11/1996 | Welch et al. | |
| 5,576,282 | A | 11/1996 | Miracle et al. | |
| 5,595,967 | A | 1/1997 | Miracle et al. | |
| 5,597,936 | A | 1/1997 | Perkins et al. | |
| 5,620,952 | A | 4/1997 | Fu et al. | |
| 5,691,297 | A | 11/1997 | Nassano et al. | |
| 5,879,584 | A | 3/1999 | Bianchetti et al. | |
| 6,004,922 | A | 12/1999 | Watson et al. | |
| 6,008,181 | A | 12/1999 | Cripe et al. | |
| 6,020,303 | A | 2/2000 | Cripe et al. | |
| 6,022,844 | A | 2/2000 | Baillely et al. | |
| 6,060,443 | A | 5/2000 | Cripe et al. | |
| 6,093,856 | A | 7/2000 | Cripe et al. | |
| 6,136,769 | A | 10/2000 | Asano et al. | |
| 6,221,825 | B1 | 4/2001 | Williams, Jr. et al. | |
| 6,225,464 | B1 | 5/2001 | Hiler, II et al. | |
| 6,274,540 | B1 | 8/2001 | Scheibel et al. | |
| 6,291,412 | B1 | 9/2001 | Kvita et al. | |
| 6,306,812 | B1 | 10/2001 | Perkins et al. | |
| 6,326,348 | B1 | 12/2001 | Vinson et al. | |
| 6,433,207 | B1 | 8/2002 | Connor | |
| 6,482,994 | B2 | 11/2002 | Scheper et al. | |
| 6,514,926 | B1 | 2/2003 | Kott et al. | |
| 6,583,096 | B1 | 6/2003 | Kott et al. | |
| 6,596,680 | B2 | 7/2003 | Kott et al. | |
| 6,602,840 | B1 | 8/2003 | Scheibel et al. | |
| 6,673,961 | B2 | 1/2004 | Connor et al. | |
| 6,844,309 | B1 | 1/2005 | Sivik et al. | |
| 6,908,894 | B2 | 6/2005 | Kott et al. | |
| 7,078,373 | B2 | 7/2006 | Burrows et al. | |
| 2003/0087790 | A1 | 5/2003 | Puelle et al. | |
| 2003/0087791 | A1 | 5/2003 | Bonelli et al. | |
| 2004/0048764 | A1 | 3/2004 | Kim et al. | |

(Continued)

FOREIGN PATENT DOCUMENTS

| | | | |
|---|---|---|---|
| EP | 0 051 232 | A | 5/1982 |

(Continued)

OTHER PUBLICATIONS

PCT International Search Report Dated May 27, 2009—7 pgs.

*Primary Examiner*—Brian P Mruk
(74) *Attorney, Agent, or Firm*—Julie A. McConihay; David V. Upite; Steven W. Miller

(57) ABSTRACT

A detergent composition comprising:

from 0.01% to 90% by weight of a surfactant system, one or more detergency builder(s), comprising a phosphate builder, and the phosphate builder containing pyrophosphate, wherein the composition comprises at most 12% by weight of phosphate builder(s) and the phosphate builder(s) comprise (s) at least 40% by weight of pyrophosphate(s).

8 Claims, No Drawings

U.S. PATENT DOCUMENTS

| | | | |
|---|---|---|---|
| 2005/0003983 | A1 | 1/2005 | Kim et al. |
| 2005/0032670 | A1 | 2/2005 | Besseling |
| 2005/0227891 | A1 | 10/2005 | Dreyer et al. |
| 2008/0035885 | A1 | 2/2008 | Hage et al. |
| 2009/0005284 | A1 | 1/2009 | Chretien et al. |

FOREIGN PATENT DOCUMENTS

| | | | | |
|---|---|---|---|---|
| EP | 0 312 278 | A | | 4/1989 |
| EP | 1 903 095 | A | | 3/2008 |
| ES | 2 231 010 | A1 | | 5/2005 |
| GB | 1 531 433 | A | | 11/1978 |
| GB | 1531433 | | * | 11/1978 |
| GB | 2 046 293 | A | | 11/1980 |
| GB | 2 170 817 | A | | 8/1986 |
| JP | 54 159414 | A | | 12/1979 |
| JP | 54159414 | A2 | * | 12/1979 |
| WO | WO 92/06162 | | | 4/1992 |
| WO | WO 95/27038 | | * | 10/1995 |
| WO | WO 95/27038 | A | | 10/1995 |
| WO | WO 97/48785 | A | | 12/1997 |
| WO | WO 98/30672 | A | | 7/1998 |
| WO | WO 98/35002 | | | 8/1998 |
| WO | WO 98/35003 | | | 8/1998 |
| WO | WO 98/35004 | | | 8/1998 |
| WO | WO 98/35005 | | | 8/1998 |
| WO | WO 98/35006 | | | 8/1998 |
| WO | WO 99/05084 | A1 | | 2/1999 |
| WO | WO 99/51714 | C1 | | 12/1999 |
| WO | WO 00/47708 | | | 4/2000 |
| WO | WO 00/32601 | A3 | | 10/2000 |
| WO | WO 03/010272 | A | | 2/2003 |

* cited by examiner

DETERGENT COMPOSITION COMPRISING A SURFACTANT SYSTEM AND A PYROPHOSPHATE

FIELD OF THE INVENTION

The present invention relates to detergent compositions, for example laundry detergents, with a low amount of phosphate builder. The invention also relates to the use of pyrophosphate in detergent compositions to promote suds formation.

BACKGROUND OF THE INVENTION

Limitation of the amount of chemical components in a detergent composition may limit the cost and make the composition more environmentally friendly. Accordingly, it is a constant duty for the fabricant of detergent compositions to reduce the quantity of chemical components in his compositions while still satisfying several criteria for the composition to be effective, such as cleaning and whiteness performance.

However, the benefits of limiting the chemistry are reduced if the consumer uses more product than required. This may especially happen if the consumer is not aware of the new product properties or if he relies on indirect factors, such as the presence of suds, to dose the product. The presence of suds in a washing or laundering operation has long been used by the consumer as a signal that the detergent is effective.

The need exists for a detergent composition which provides effective cleaning with reduced chemistry, which provides suds-formation, and which maintains suds volume and suds retention. It is an object of the present invention to provide a detergent composition with reduced chemistry which maintains a high level of suds as long as the composition is effective for its purpose. The present inventors have surprisingly found that pyrophosphates have a better capacity to promote suds-forming, suds volume, and/or suds duration than other phosphate builders such as tripolyphosphate.

Phosphate builders have been used in detergent compositions for many years. However, the use of pyrophosphate has been generally considered disadvantageous compared to other phosphate builders and therefore limited. Conventional formulations built with pyrophosphate exhibit a reduction in builder effectiveness as the level of pyrophosphate in the wash water decreases relative to the water hardness level, i.e. when the product is used at close to underbuilt conditions. This reduction in builder effectiveness is called the "pyro dip". The pyro dip represents those molar ratios of builder capacity to hardness (B:H ratio) approaching and below 1:1 (compared to an overbuilt condition where the molar ratio of builder to hardness is greater than 1:1) where the pyrophosphate complex is insoluble and precipitates. The effect of the pyro dip in the washing process is an increase in soil redeposition on the clothes. Accordingly, preferred phosphate builders in detergent compositions are usually selected from other phosphates, such as tripolyphosphate, rather than pyrophosphate.

In the presence of moisture, linear polyphosphates can be hydrolysed to lower phosphate including orthophosphate and pyrophosphate. This reaction is called the reversion reaction. This hydrolysis can be accelerated at higher temperature (generally above 39° C.), and at extreme acidic or alkali conditions of pH, for example pH below 4 or 5 or above 9 or 10. Until now, when a composition comprising tripolyphosphate undergoes detergent processing, for example in a spray drying step, the amount of pyrophosphate in the composition is monitored to ensure that it is kept at an acceptably low level.

In one embodiment of the invention the pyrophosphate may be made in situ in the detergent making step by selection of temperature and/or air flow and/or other chemical constituents and/or pH and/or moisture conditions to increase reversion.

The inventors have now surprisingly found that a higher proportion of pyrophosphate can be acceptable and even desirable as they have found that pyrophosphate has a better capacity than tripolyphosphate to promote suds formation and increase suds volume and duration while not impairing the whiteness of the fabric when used in the compositions of the invention.

SUMMARY OF THE INVENTION

In accordance with a first aspect of the present invention, there is provided a detergent composition comprising:

from 0.01% to 90% by weight of a surfactant system, one or more detergency builder(s), comprising a phosphate builder, and the phosphate builder comprising pyrophosphate, wherein the composition comprises at most 12% by weight of phosphate builder(s) and the phosphate builder(s) comprise (s) at least 40% by weight of pyrophosphate.

The weight percentages above, and in the entire specification are to be understood as anhydrous weight percentages.

The invention also concerns, according to another aspect, a method for laundering fabrics comprising at least the steps of:

introducing a composition according to the invention in water in such an amount that the B:H ratio is at most 0.8 to provide an aqueous laundering composition, contacting a fabric to be laundered with said aqueous laundering composition.

Whilst not wishing to be bound by theory, it is believed that when used in underbuilt water, the high level of free hardness prevents the generation of large pyrophosphate crystals. As such, the redeposition of pyrophosphate on the fabric is decreased.

The detergent compositions according to the invention, comprising a lower amount of phosphate builder and a higher ratio of pyrophosphate not only provide good cleaning results, in particular a good whiteness of the fabric, but also exhibit satisfying suds promotion, volume, and duration.

According to a further aspect, the invention concerns the use of pyrophosphate in a detergent composition to promote suds formation and/or to increase suds volume and/or duration. The detergent composition may be a laundry composition. In particular, the detergent composition is a detergent composition as defined above.

DETAILED DESCRIPTION OF THE INVENTION

Detergency Builder

The present invention relates to a detergent composition comprising at least one detergency builder. The detergency builder comprises at least a phosphate builder, and the phosphate builder comprises at least one pyrophosphate builder.

As used herein, the term "phosphate builder" refers to a phosphate-containing builder. Typically, the phosphate builder is in the form of a salt, particularly an alkali metal salt, or any combination thereof.

The pyrophosphate builder(s) may be a pyrophosphate salt, in particular an alkali metal salt, or any combination thereof. By way of example, a pyrophosphate builder may be tetrasodium pyrophosphate (TSPP) which has a structure $Na_4O_7P_2$.

The composition may comprise from 1 to 12%, in particular from 2 to 10%, especially from 2 to 8%, for example from 3 to 6% by weight of pyrophosphate builder(s).

In addition to the pyrophosphate builder(s), the phosphate builder(s) may comprise one or more additional phosphate builder(s). Additional phosphate builders are typically selected from the group consisting of: orthophosphate, tripolyphosphate, glassy polymeric metaphosphate, alkyl phosphonate, linear polyphosphates, cyclic metaphosphates, any salt thereof, any alkali metal salt thereof, and combinations thereof. Additional phosphate builders are most preferably tripolyphosphate and orthophosphate and combinations thereof, in particular sodium tripolyphosphate (STPP) and trisodium orthophosphate and combinations thereof.

Sodium tripolyphosphate has a structure $Na_5O_{10}P_3$. Trisodium orthophosphate has a structure $Na_3O_4P$.

The total amount of phosphate builder(s) in the composition is at most 12% by weight. The composition may comprise from 1 to 12%, in particular from 2 to 10%, especially from 2 to 8%, for example from 3 to 6% by weight, of phosphate builder.

The phosphate builder(s) of the composition comprise at least 40% by weight of pyrophosphate builder(s). The phosphate builder(s) may comprise from 45 to 100%, in particular from 50 to 90%, for example from 60 to 80%, by weight of pyrophosphate builder(s).

In one particular embodiment, the phosphate builder(s) comprises pyrophosphate, tri-polyphosphate and orthophosphate. In particular the composition may comprise tetrasodium pyrophosphate, sodium tri-polyphosphate (STPP), and trisodium orthophosphate.

In the composition, the reversion rate which is the weight ratio (pyrophosphate+orthophosphate)/(tri-polyphosphate+pyrophosphate+orthophosphate) may be at least equal to 0.40, in particular at least equal to 0.45, especially at least equal to 0.50, or even at least equal to 0.60.

In addition to the phosphate builder(s), the detergency builder(s) may comprise one or more alumininosilicate builder(s). Aluminosilicate builders are selected from the group consisting of aluminosilicates, salts thereof, and combinations thereof, preferably amorphous aluminosilicates, crystalline aluminosilicates, mixed amorphous/crystalline aluminosilicates, alkali metal salts thereof, and combinations thereof, most preferably zeolite A, zeolite P, zeolite MAP, salts thereof, and combinations thereof.

The total amount of phosphate builder(s) and aluminosilicate builder(s) in the composition may be comprised from 1 to 12%, or even from 1 to 10%, in particular from 2 to 9%, especially from 2 to 8%, for example from 3 to 6%, by weight.

Pyrophosphate builder(s) may represent at least 40%, for example from 45 to 100%, in particular from 50 to 90%, for example from 60 to 80%, by weight of the total amount of phosphate builder(s) and aluminosilicate builder(s).

The detergency builder(s) may also comprise one or more preferred additional builder(s). Preferred additional builders are selected from the group consisting of: polycarboxylic acids and salts thereof, preferably citric acid, alkali metal salts thereof, and combinations thereof; additional silicates such as layered silicates, and combinations thereof.

The total amount of phosphate builder(s), aluminosilicate builder(s), polycarboxylic acid builder(s), and additional silicate builder(s) in the composition may be comprised from 1 to 12%, or even from 1 to 10%, in particular from 2 to 9%, especially from 2 to 8%, for example from 3 to 6%, by weight.

Pyrophosphate builder(s) may represent at least 40%, for example from 45 to 100%, in particular from 50 to 90%, for example from 60 to 80%, by weight of the total amount of phosphate builder(s), aluminosilicate builder(s), polycarboxylic acid builder(s), and additional silicate builder(s).

The composition may further comprise any other supplemental builder(s), chelant(s), or, in general, any material which will remove calcium ions from solution by, for example, sequestration, complexation, precipitation or ion exchange. In particular the composition may comprise materials having at a temperature of 25° C. and at a 0.1M ionic strength a calcium binding capacity of at least 50 mg/g and a calcium binding constant log K $Ca^{2+}$ of at least 3.50.

In the composition of the invention, the total amount of phosphate builder(s), aluminosilicate builder(s), polycarboxylic acid builder(s), additional silicate builder(s), and other material(s) having a calcium binding capacity superior to 50 mg/g and a calcium binding constant higher than 3.50 in the composition may be comprised from 1 to 12%, for example from 1 to 10%, in particular from 2 to 9%, especially from 2 to 8%, for example from 3 to 6%, by weight.

Pyrophosphate builder(s) may represent at least 40%, for example from 45 to 100%, in particular from 50 to 90%, especially from 60 to 80%, by weight of the total amount of phosphate builder(s), aluminosilicate builder(s), polycarboxylic acid builder(s), additional silicate builder(s), and other material(s) having a calcium binding capacity superior to 50 mg/g and calcium binding constant higher than 3.50.

Calcium carbonate has a binding calcium constant inferior to 3.50 at a temperature of 25° C. and 0.1M ionic strength.

In the composition of the invention, the total amount of material(s), excluding sodium carbonate, which will remove calcium ions from solution may be comprised from 1 to 12%, for example from 1 to 10%, in particular from 2 to 9%, especially from 2 to 8%, for example from 3 to 6%, by weight.

Pyrophosphate builder(s) may represent at least 40%, for example from 45 to 100%, in particular from 50 to 90%, especially from 60 to 80%, by weight of the total amount of material(s), excluding sodium carbonate, which will remove calcium ions from solution.

In the composition of the invention, the total amount of material(s) which will remove calcium ions from solution may be comprised from 1 to 12%, for example from 1 to 10%, in particular from 2 to 9%, especially from 2 to 8%, for example from 3 to 6%, by weight.

Pyrophosphate builder(s) may represent at least 40%, for example from 45 to 100%, in particular from 50 to 90%, especially from 60 to 80%, by weight of the total amount of material(s) which will remove calcium ions from solution.

Surfactant System

The detergent compositions according to the present invention comprise a surfactant or surfactant system wherein the surfactant may be selected from nonionic surfactants, anionic surfactants, cationic surfactants, ampholytic surfactants, zwitterionic surfactants, semi-polar nonionic surfactants and mixtures thereof.

Anionic Surfactants

Suitable anionic surfactants typically comprise one or more moieties selected from the group consisting of carbonate, phosphate, phosphonate, sulphate, sulphonate, carboxylate and mixtures thereof. The anionic surfactant may be one or mixtures of more than one of $C_{8-18}$ alkyl sulphates and $C_{8-18}$ alkyl sulphonates. Suitable anionic surfactants incorporated alone or in mixtures in the compositions of the invention are also the $C_{8-18}$ alkyl sulphates and/or $C_{8-18}$ alkyl sulphonates optionally condensed with from 1 to 9 moles of $C_{1-4}$ alkylene oxide per mole of $C_{8-18}$ alkyl sulphate and/or $C_{8-18}$ alkyl sulphonate. The alkyl chain of the $C_{8-18}$ alkyl sulphates and/or $C_{8-18}$ alkyl sulphonates may be linear or branched, preferred branched alkyl chains comprise one or more branched moieties that are $C_{1-6}$ alkyl groups. More particularly, suitable anionic surfactants include the $C_{10}$-$C_{20}$ primary, branched-chain, linear-chain and random-chain alkyl sulphates (AS), typically having the following formula:

$$CH_3(CH_2)_xCH_2—OSO_3^-M^+$$

wherein, M is hydrogen or a cation which provides charge neutrality, preferred cations are sodium and ammonium cations, wherein x is an integer of at least 7, preferably at least 9; $C_{10}$-$C_{18}$ secondary (2,3) alkyl sulphates, typically having the following formula:

$$CH_3(CH_2)_x(CH)(OSO_3^-M^+)CH_3 \quad \text{or} \quad CH_3(CH_2)_y(CH)(OSO_3^-M^+)CH_2CH_3$$

wherein, M is hydrogen or a cation which provides charge neutrality, preferred cations include sodium and ammonium cations, wherein x is an integer of at least 7, preferably at least 9, y is an integer of at least 8, preferably at least 9; $C_{10}$-$C_{18}$ alkyl alkoxy carboxylates; mid-chain branched alkyl sulphates as described in more detail in U.S. Pat. No. 6,020,303 and U.S. Pat. No. 6,060,443; modified alkylbenzene sulphonate (MLAS) as described in more detail in WO 99/05243, WO 99/05242, WO 99/05244, WO 99/05082, WO 99/05084, WO 99/05241, WO 99/07656, WO 00/23549, and WO 00/23548 and mixtures thereof.

Preferred anionic surfactants are $C_{8-18}$ alkyl benzene sulphates and/or $C_{8-18}$ alkyl benzene sulphonates. The alkyl chain of the $C_{8-18}$ alkyl benzene sulphates and/or $C_{8-18}$ alkyl benzene sulphonates may be linear or branched, preferred branched alkyl chains comprise one or more branched moieties that are $C_{1-6}$ alkyl groups.

Other preferred anionic surfactants are selected from the group consisting of: $C_{8-18}$ alkenyl sulphates, $C_{8-18}$ alkenyl sulphonates, $C_{8-18}$ alkenyl benzene sulphates, $C_{8-18}$ alkenyl benzene sulphonates, $C_{8-18}$ alkyl di-methyl benzene sulphate, $C_{8-18}$ alkyl di-methyl benzene sulphonate, fatty acid ester sulphonates, di-alkyl sulphosuccinates, and combinations thereof. Other useful anionic surfactants herein include the esters of alpha-sulfonated fatty acids, typically containing from 6 to 20 carbon atoms in the fatty acid group and from 1 to 10 carbon atoms in the ester group; 2-acyloxy-alkane-1-sulfonic acid and salts thereof, typically containing from about 2 to 9 carbon atoms in the acyl group and from about 9 to 23 carbon atoms in the alkane moiety; alpha-olefin sulfonates (AOS), typically containing from about 12 to 24 carbon atoms; and beta-alkoxy alkane sulfonates, typically containing from about 1 to 3 carbon atoms in the alkyl group and from about 8 to 20 carbon atoms in the alkane moiety. Also useful are the sulphonation products of fatty acid esters containing an alkyl group typically with from 10 to 20 carbon atoms. Preferred are $C_{1-4}$, most preferably methyl ester sulphonates. Preferred are $C_{16-18}$ methyl ester sulphonates (MES).

The anionic surfactants may be present in the salt form. For example, the anionic surfactant(s) may be an alkali metal salt of any of the above. Preferred alkali metals are sodium, potassium and mixtures thereof.

Preferred anionic detersive surfactants are selected from the group consisting of: linear or branched, substituted or unsubstituted, $C_{12-18}$ alkyl sulphates; linear or branched, substituted or unsubstituted, $C_{10-13}$ alkylbenzene sulphonates, preferably linear $C_{10-13}$ alkylbenzene sulphonates; and mixtures thereof. Highly preferred are linear $C_{10-13}$ alkylbenzene sulphonates. Highly preferred are linear $C_{10-13}$ alkylbenzene sulphonates that are obtainable, preferably obtained, by sulphonating commercially available linear alkyl benzenes (LAB); suitable LAB include low 2-phenyl LAB, such as those supplied by Sasol under the tradename Isochem® or those supplied by Petresa under the tradename Petrelab®, other suitable LAB include high 2-phenyl LAB, such as those supplied by Sasol under the tradename Hyblene®.

It may be preferred for the anionic detersive surfactant to be structurally modified in such a manner as to cause the anionic detersive surfactant to be more calcium tolerant and less likely to precipitate out of the wash liquor in the presence of free calcium ions. This structural modification could be the introduction of a methyl or ethyl moiety in the vicinity of the head group of the anionic detersive surfactant, as this can lead to a more calcium tolerant anionic detersive surfactant due to steric hindrance of the head group, which may reduce the affinity of the anionic detersive surfactant for complexing with free calcium cations in such a manner as to cause precipitation out of solution. Other structural modifications include the introduction of functional moieties, such as an amine moiety, in the alkyl chain of the anionic detersive surfactant; this can lead to a more calcium tolerant anionic detersive surfactant because the presence of a functional group in the alkyl chain of an anionic detersive surfactant may minimise the undesirable physicochemical property of the anionic detersive surfactant to form a smooth crystal structure in the presence of free calcium ions in the wash liquor. This may reduce the tendency of the anionic detersive surfactant to precipitate out of solution.

Typically, the detergent composition comprises from 1 to 50 wt % anionic surfactant, more typically from 2 to 40 wt %. Alkyl benzene sulphonates are preferred anionic surfactants.

Alkoxylated Anionic Surfactants

The composition may comprise an alkoxylated anionic surfactant. Preferably, the alkoxylated anionic detersive surfactant is a linear or branched, substituted or unsubstituted $C_{12-18}$ alkyl alkoxylated sulphate having an average degree of alkoxylation of from 1 to 30, preferably from 1 to 10. Preferably, the alkoxylated anionic detersive surfactant is a linear or branched, substituted or unsubstituted $C_{12-18}$ alkyl ethoxylated sulphate having an average degree of ethoxylation of from 1 to 10. Most preferably, the alkoxylated anionic detersive surfactant is a linear unsubstituted $C_{12-18}$ alkyl ethoxylated sulphate having an average degree of ethoxylation of from 3 to 7.

Suitable alkoxylated anionic detersive surfactants are: Texapan LEST™ by Cognis; Cosmacol AES™ by Sasol; BES151™ by Stephan; Empicol ESC70/U™; and mixtures thereof.

Where present alkoxylated anionic surfactant(s) will generally be present in amounts form 0.1 wt % to 40 wt %, generally 0.1 to 10 wt % based on the detergent composition as a whole. It may be preferred for the composition to comprise from 3 wt % to 5 wt % alkoxylated anionic detersive surfactant, or it may be preferred for the composition to comprise from 1 wt % to 3 wt % alkoxylated anionic detersive surfactant.

The alkoxylated anionic detersive surfactant may also increase the non-alkoxylated anionic detersive surfactant activity by making the non-alkoxylated anionic detersive surfactant less likely to precipitate out of solution in the presence of free calcium cations. Preferably, the weight ratio of non-alkoxylated anionic detersive surfactant to alkoxylated anionic detersive surfactant is less than 5:1, or less than 3:1, or less than 1.7:1, or even less than 1.5:1. This ratio gives optimal whiteness maintenance performance combined with a good hardness tolerency profile and a good sudsing profile. However, it may be preferred that the weight ratio of non-alkoxylated anionic detersive surfactant to alkoxylated anionic detersive surfactant is greater than 5:1, or greater than 6:1, or greater than 7:1, or even greater than 10:1. This ratio gives optimal greasy soil cleaning performance combined with a good hardness tolerency profile, and a good sudsing profile.

Non-Ionic Detersive Surfactant

The compositions of the invention may comprise non-ionic surfactant. The inclusion of non-ionic detersive surfactant in the composition helps to provide a good overall cleaning profile, especially when laundering at high temperatures such as 60° C. or higher.

The non-ionic detersive surfactant can be selected from the group consisting of: $C_{12}$-$C_{18}$ alkyl ethoxylates, such as, NEODOL® non-ionic surfactants from Shell; $C_6$-$C_{12}$ alkyl phenol alkoxylates wherein the alkoxylate units are ethyleneoxy units, propyleneoxy units or a mixture thereof; $C_{12}$-$C_{18}$ alcohol and $C_6$-$C_{12}$ alkyl phenol condensates with ethylene oxide/propylene oxide block polymers such as Pluronic® from BASF; $C_{14}$-$C_{22}$ mid-chain branched alcohols, BA, as described in more detail in U.S. Pat. No. 6,150,322; $C_{14}$-$C_{22}$ mid-chain branched alkyl alkoxylates, $BAE_x$, wherein x=from 1 to 30, as described in more detail in U.S. Pat. No. 6,153,577, U.S. Pat. No. 6,020,303 and U.S. Pat. No. 6,093,856; alkylpolysaccharides as described in more detail in U.S. Pat. No. 4,565,647, specifically alkylpolyglycosides as described in more detail in U.S. Pat. No. 4,483,780 and U.S. Pat. No. 4,483,779; polyhydroxy fatty acid amides as described in more detail in U.S. Pat. No. 5,332,528, WO 92/06162, WO 93/19146, WO 93/19038, and WO 94/09099; ether capped poly(oxyalkylated) alcohol surfactants as described in more detail in U.S. Pat. No. 6,482,994 and WO 01/42408; and mixtures thereof.

The non-ionic detersive surfactant could be an alkyl polyglucoside and/or an alkyl alkoxylated alcohol. Preferably the non-ionic detersive surfactant is a linear or branched, substituted or unsubstituted $C_{8-18}$ alkyl ethoxylated alcohol having an average degree of ethoxylation of from 1 to 50, more preferably from 3 to 40. Non-ionic surfactants having a degree of ethoxylation from 3 to 9 may be especially useful either. Nonionic surfactants having an HLB value of from 13 to 25, such as $C_{8-18}$ alkyl ethoxylated alcohols having an average degree of ethoxylation from 15 to 50, or even from 20 to 50 may also be preferred non-ionic surfactants in the compositions of the invention. Examples of these latter non-ionic surfactants are Lutensol AO30 and similar materials disclosed in WO04/041982. These may be beneficial as they have good lime soap dispersant properties.

When present, non ionic detersive surfactant(s) is generally present in amounts of from 0.5 to 20 wt %, more typically 0.5 to 10 wt % based on the total weight of the composition. The composition may comprise from 1 wt % to 7 wt % or from 2 wt % to 4 wt % non-ionic detersive surfactant.

The non-ionic detersive surfactant not only provides additional soil cleaning performance but may also increase the anionic detersive surfactant activity by making the anionic detersive surfactant less likely to precipitate out of solution in the presence of free calcium cations. Preferably, the weight ratio of non-alkoxylated anionic detersive surfactant to non-ionic detersive surfactant is in the range of less than 8:1, or less than 7:1, or less than 6:1 or less than 5:1, preferably from 1:1 to 5:1, or from 2:1 to 5:1, or even from 3:1 to 4:1.

Cationic Detersive Surfactant

In one aspect of the invention, the detergent compositions are free of cationic surfactant. However, the composition optionally may comprise a cationic detersive surfactant. Suitable cationic detersive surfactants are alkyl pyridinium compounds, alkyl quaternary ammonium compounds, alkyl quaternary phosphonium compounds, and alkyl ternary sulphonium compounds. The cationic detersive surfactant can be selected from the group consisting of: alkoxylate quaternary ammonium (AQA) surfactants as described in more detail in U.S. Pat. No. 6,136,769; dimethyl hydroxyethyl quaternary ammonium as described in more detail in U.S. Pat. No. 6,004,922; polyamine cationic surfactants as described in more detail in WO 98/35002, WO 98/35003, WO 98/35004, WO 98/35005, and WO 98/35006; cationic ester surfactants as described in more detail in U.S. Pat. No. 4,228,042, U.S. Pat. No. 4,239,660, U.S. Pat. No. 4,260,529 and U.S. Pat. No. 6,022,844; amino surfactants as described in more detail in U.S. Pat. No. 6,221,825 and WO 00/47708, specifically amido propyldimethyl amine; and mixtures thereof. Preferred cationic detersive surfactants are quaternary ammonium compounds having the general formula:

$$(R)(R^1)(R^2)(R^3)N^+X^-$$

wherein, R is a linear or branched, substituted or unsubstituted $C_{6-18}$ alkyl or alkenyl moiety, $R^1$ and $R^2$ are independently selected from methyl or ethyl moieties, $R^3$ is a hydroxyl, hydroxymethyl or a hydroxyethyl moiety, X is an anion which provides charge neutrality, preferred anions include halides (such as chloride), sulphate and sulphonate. Preferred cationic detersive surfactants are mono-$C_{6-18}$ alkyl mono-hydroxyethyl di-methyl quaternary ammonium chlorides. Highly preferred cationic detersive surfactants are mono-$C_{8-10}$ alkyl mono-hydroxyethyl di-methyl quaternary ammonium chloride, mono-$C_{10-12}$ alkyl mono-hydroxyethyl di-methyl quaternary ammonium chloride and mono-$C_{10}$ alkyl mono-hydroxyethyl di-methyl quaternary ammonium chloride. Cationic surfactants such as Praepagen HY (tradename Clariant) may be useful and may also be useful as a suds booster.

When present, preferably the composition comprises from 0.1 wt % to 10 or 5 wt %, or from 0.5 wt % to 3 wt %, or from 1% to 3 wt %, or even from 1 wt % to 2 wt % cationic detersive surfactant. This is the optimal level of cationic detersive surfactant to provide good cleaning.

The cationic detersive surfactant provides additional greasy soil cleaning performance. However, the cationic detersive surfactant may increase the tendency of any non-alkoxylated anionic detersive surfactant to precipitate out of solution. Preferably, the cationic detersive surfactant and any non-alkoxylated anionic detersive surfactant are separated in the detergent composition of the invention, for example if cationic surfactant is present, preferably the cationic and any anionic surfactant, particularly non-alkoxylated anionic surfactant will be present in the composition in separate particles. This minimises any effect that any cationic detersive surfactant may have on the undesirable precipitation of the anionic detersive surfactant, and also ensures that upon contact with water, the resultant wash liquor is not cloudy. If cationic surfactant is present, preferably the weight ratio of non-alkoxylated anionic detersive surfactant to cationic detersive surfactant is in the range of from 5:1 to 25:1, more preferably from 5:1 to 20:1 or from 6:1 to 15:1, or from 7:1 to 10:1, or even from 8:1 to 9:1.

Preferred compositions of the present invention comprise at least two different surfactants in combination comprising at least one selected from a first group, the first group comprising alkyl benzene sulphonate and MES surfactant; and at least one selected from a second group, the second group comprising alkoxylated anionic surfactant, MES and alkoxylated non-ionic surfactant and alpha olefin sulfonates (AOS). A particularly preferred combination comprises alkyl benzene sulphonate, preferably LAS in combination with MES. A further particularly preferred combination comprises alkyl benzene sulphonate, preferably LAS with an alkoxylated anionic surfactant, preferably $C_{8-18}$ alkyl alkoxylated sulphate having an average degree of alkoxylation of from 1 to 10. A third particularly preferred combination comprises alkyl benzene sulphonate, preferably LAS in combination with an alkoxylated non-ionic surfactant, preferably $C_{8-18}$ alkyl ethoxylated alcohol having a degree of alkoxylation of from 15 to 50, preferably from 20 to 40.

The weight ratio of the surfactant from the first group to the weight ratio of the surfactant from the second group is typically 1:5 to 100:1, preferably 1:2 to 100:1 or 1:1 to 50:1 or even to 20:1 or 10:1. The levels of the surfactants are as described above under the specific classes of surfactants. Presence of AE3S and/or MES in the system is preferred on account of their exceptional hardness-tolerance.

In a further embodiment, the surfactant in the detergent compositions of the invention comprises at least three surfactants, at least one from each of the first and second groups defined above and in addition a third surfactant, preferably also from the first or second groups defined above.

The compositions of the invention comprises from 0.01% to 90% of a surfactant system. The surfactant system may be present at a level of from about 0.1% to about 50%, from about 1% to about 25%, preferably from about 2% to 16%, or even from about 3% to about 12% or from 5 to 10%, by weight of the subject composition.

Adjuncts

While not essential for the purposes of the present invention, the non-limiting list of adjuncts illustrated hereinafter are suitable for use in the instant compositions and may be desirably incorporated in certain embodiments of the invention. The precise nature of these additional adjunct components, and levels of incorporation thereof, will depend on the physical form of the composition and the nature of the cleaning operation for which it is to be used. Suitable adjunct materials include, but are not limited to, additional surfactants, additional builders, additional chelating agents, suds boosting co-surfactants, dye transfer inhibiting agents, dispersants, enzymes and enzyme stabilizers, catalytic materials, bleach activators, hydrogen peroxide, sources of hydrogen peroxide, preformed peracids, polymeric dispersing agents, clay soil removal/anti-redeposition agents, brighteners, suds suppressors, dyes, perfumes, structure elasticizing agents, fabric softeners, carriers, hydrotropes, processing aids, solvents and/or pigments. In addition to the disclosure below, suitable examples of such other adjuncts and levels of use are found in U.S. Pat. Nos. 5,576,282, 6,306,812 B1 and 6,326,348 B1 that are incorporated by reference. When one or more adjuncts are present, such one or more adjuncts may be present as detailed below:

SUDS BOOSTING CO-SURFACTANT—The composition may comprise from about 0.2% to about 6%, or from about 0.3% to about 4%, or from about 0.4% to about 3% by weight of a suds boosting co-surfactant having the following formula (I):

$$R—O—(CH_2CH_2O)_nSO_3^-M^+ \quad (I)$$

wherein R is a branched or unbranched alkyl group having from about 8 to about 16 carbon atoms, n is from 0 to 3, M is a cation of alkali metal, alkaline earth metal or ammonium.

Preferred suds boosting co-surfactant herein is a $C_{10}$-$C_{14}$ linear alkyl sulphate, such as a sodium salt of $C_{10}$-$C_{14}$ linear alkyl sulphate, i.e., a surfactant of formula (I), wherein the R group in formula (I) is a $C_{10}$-$C_{14}$ linear alkyl group, n is 0. Non-limiting linear alkyl sulphates useful herein as the suds boosting co-surfactants are sodium decyl sulfate, sodium lauryl sulfate, sodium tetradecyl sulfate, and mixtures thereof. All of these surfactants are well known in the art and are commercially available from a variety of sources.

Another preferred suds boosting co-surfactant herein is a branched alkyl sulphate optionally condensed with from 1 to 3 moles of ethylene oxide, i.e. a surfactant of formula (I), wherein R is a branched alkyl group. Illustrative branched R group include a branched alkyl group having the following formula (II):

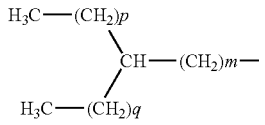

(II)

wherein p, q and m are independently selected from integers of from 0 to 13, provided that $5 \leqq p+q+m \leqq 13$.

Non-limiting examples of suitable branched alkyl sulphate and branched alkyl ethoxylated sulfate include surfactants having the following chemical structure:

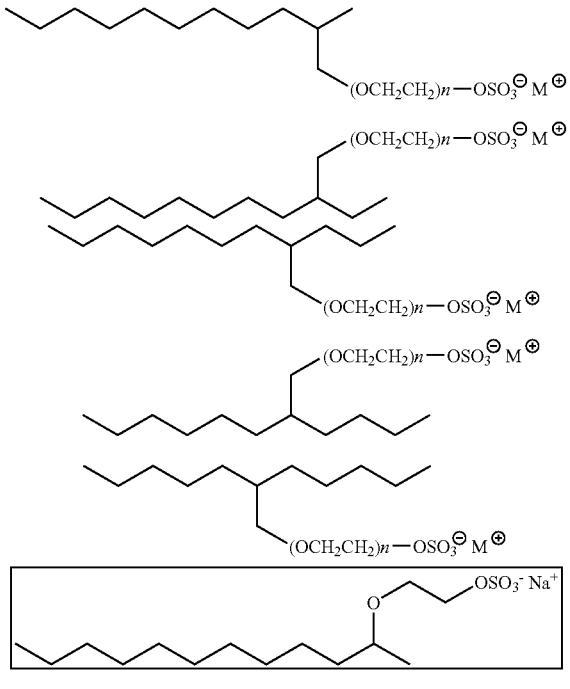

Branched alkyl sulfates and branched alkyl ethoxylated sulfates are commercially available normally as a mixture of linear isomer and branched isomer with a variety of chain lengths, degrees of ethoxylation and degrees of branching. These include but are not limited to Empimin® KSL68/A and Empimin® KSN70/LA by Albright & Wilson with $C_{12-13}$ chain length distribution, about 60% branching and having an average ethoxylation of 1 and 3, Dobanol® 23 ethoxylated sulphates from Shell with $C_{12-13}$ chain length distribution, about 18% branching and having an average ethoxylation of 0.1 to 3, sulphated Lial® 123 ethoxylates from Condea Augusta with $C_{12-13}$ chain length distribution, about 60% branching and an average ethoxylation of 0.1 to 3 and sulphated Isalchem® 123 alkoxylates with $C_{12-13}$ chain length distribution and about 95% branching.

Also, suitable alkyl ethoxylated sulfates can be prepared by ethoxylating and sulfating the appropriate alcohols, as described in "Surfactants in Consumer Products" edited by J. Falbe and "Fatty oxo-alcohols: Relation between the alkyl chain structure and the performance of the derived AE, AS, AES" submitted to the $4^{th}$ World Surfactants, Barcelona, 3-7 VI 1996 Congress by Condea Augusta. Commercial oxo-alcohols are a mixture of primary alcohols containing several isomers and homologues. Industrial processes allow one to separate these isomers hence resulting in alcohols with linear isomer content ranging from 5-10% to up to 95%. Examples of available alcohols for ethoxylation and sulfation are Lial® alcohols by Condea Augusta (60% branched), Isalchem® alcohols by Condea Augusta (95% branched), Dobanol® alcohols by Shell (18% linear).

Additional process for preparing branched alkyl sulfates and branched ethoxylated sulfates are for example described in U.S. Pat. No. 6,020,303, U.S. Pat. No. 6,060,443, U.S. Pat. No. 6,008,181 and U.S. Pat. No. 6,020,303.

BLEACHING AGENTS—The detergent compositions of the present invention may comprise one or more bleaching agents. Suitable bleaching agents other than bleaching catalysts include other photobleaches, bleach activators, hydrogen peroxide, sources of hydrogen peroxide, pre-formed peracids and mixtures thereof. In general, when a bleaching agent is used, the compositions of the present invention may comprise from about 0.1% to about 50% or even from about 0.1% to about 25% bleaching agent by weight of the subject detergent composition. Examples of suitable bleaching agents include (1) photobleaches for example Vitamin K3;

(2) preformed peracids: Suitable preformed peracids include, but are not limited to, compounds selected from the group consisting of percarboxylic acids and salts, percarbonic acids and salts, perimidic acids and salts, peroxymonosulfuric acids and salts, for example, Oxone®, and mixtures thereof. Suitable percarboxylic acids include hydrophobic and hydrophilic peracids having the formula R—(C═O)O—O-M wherein R is an alkyl group, optionally branched, having, when the peracid is hydrophobic, from 6 to 14 carbon atoms, or from 8 to 12 carbon atoms and, when the peracid is hydrophilic, less than 6 carbon atoms or even less than 4 carbon atoms; and M is a counterion, for example, sodium, potassium or hydrogen;

(3) sources of hydrogen peroxide, for example, inorganic perhydrate salts, including alkali metal salts such as sodium salts of perborate (usually mono- or tetra-hydrate), percarbonate, persulphate, perphosphate, persilicate salts and mixtures thereof. In one aspect of the invention the inorganic perhydrate salts are selected from the group consisting of sodium salts of perborate, percarbonate and mixtures thereof. When employed, inorganic perhydrate salts are typically present in amounts of from 0.05 to 40 wt %, or 1 to 30 wt % of the overall composition and are typically incorporated into such compositions as a crystalline solid that may be coated. Suitable coatings include, inorganic salts such as alkali metal silicate, carbonate or borate salts or mixtures thereof, or organic materials such as water-soluble or dispersible polymers, waxes, oils or fatty soaps; and (4) bleach activators having R—(C═O)-L wherein R is an alkyl group, optionally branched, having, when the bleach activator is hydrophobic, from 6 to 14 carbon atoms, or from 8 to 12 carbon atoms and, when the bleach activator is hydrophilic, less than 6 carbon atoms or even less than 4 carbon atoms; and L is leaving group. Examples of suitable leaving groups are benzoic acid and derivatives thereof—especially benzene sulphonate. Suitable bleach activators include dodecanoyl oxybenzene sulphonate, decanoyl oxybenzene sulphonate, decanoyl oxybenzoic acid or salts thereof, 3,5,5-trimethyl hexanoyloxybenzene sulphonate, tetraacetyl ethylene diamine (TAED) and nonanoyloxybenzene sulphonate (NOBS). Suitable bleach activators are also disclosed in WO 98/17767. While any suitable bleach activator may be employed, in one aspect of the invention the subject detergent composition may comprise NOBS, TAED or mixtures thereof.

When present, the peracid and/or bleach activator is generally present in the composition in an amount of from about 0.1 to about 60 wt %, from about 0.5 to about 40 wt % or even from about 0.6 to about 10 wt % based on the composition. One or more hydrophobic peracids or precursors thereof may be used in combination with one or more hydrophilic peracid or precursor thereof.

The amounts of hydrogen peroxide source and peracid or bleach activator may be selected such that the molar ratio of available oxygen (from the peroxide source) to peracid is from 1:1 to 35:1, or even 2:1 to 10:1.

DYE TRANSFER INHIBITING AGENTS—The detergent compositions of the present invention may also include one or more dye transfer inhibiting agents. Suitable polymeric dye transfer inhibiting agents include, but are not limited to, polyvinylpyrrolidone polymers, polyamine N-oxide polymers, copolymers of N-vinylpyrrolidone and N-vinylimidazole, polyvinyloxazolidones and polyvinylimidazoles or mixtures thereof. When present in a subject composition, the dye transfer inhibiting agents may be present at levels from about 0.0001% to about 10%, from about 0.01% to about 5% or even from about 0.1% to about 3% by weight of the composition.

FLUORESCENT WHITENING AGENT—The detergent compositions of the present invention may also contain additional components that may tint articles being cleaned, such as fluorescent whitening agent. Any fluorescent whitening agent suitable for use in a laundry detergent composition may be used in the composition of the present invention. The most commonly used fluorescent whitening agents are those belonging to the classes of diaminostilbene-sulphonic acid derivatives, diarylpyrazoline derivatives and bisphenyl-distyryl derivatives. Examples of the diaminostilbene-sulphonic acid derivative type of fluorescent whitening agents include the sodium salts of:

4,4'-bis-(2-diethanolamino-4-anilino-s-triazin-6-ylamino) stilbene-2,2'-disulphonate, 4,4'-bis-(2,4-dianilino-s-triazin-6-ylamino) stilbene-2.2'-disulphonate, 4,4'-bis-(2-anilino-4(N-methyl-N-2-hydroxy-ethylamino)-s-triazin-6-ylamino) stilbene-2,2'-disulphonate, 4,4'-bis-(4-phenyl-2,1,3-triazol-2-yl)stilbene-2,2'-disulphonate, 4,4'-bis-(2-anilino-4(1-methyl-2-hydroxy-ethylamino)-s-triazin-6-ylamino) stilbene-2,2'-disulphonate and, 2-(stilbyl-4"-naptho-1.,2':4,5)-1,2,3-trizole-2"-sulphonate.

Preferred fluorescent whitening agents are Tinopal® DMS and Tinopal® CBS available from Ciba-Geigy AG, Basel, Switzerland. Tinopal® DMS is the disodium salt of 4,4'-bis-(2-morpholino-4 anilino-s-triazin-6-ylamino) stilbene disulphonate. Tinopal® CBS is the disodium salt of 2,2'-bis-(phenyl-styryl) disulphonate.

Also preferred are fluorescent whitening agents of the structure:

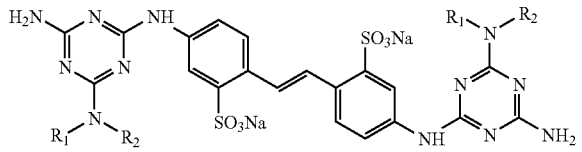

wherein $R_1$ and $R_2$, together with the nitrogen atom linking them, form an unsubstituted or $C_1$-$C_4$ alkyl-substituted morpholino, piperidine or pyrrolidine ring, preferably a morpholino ring (commercially available as Parawhite KX, supplied by Paramount Minerals and Chemicals, Mumbai, India).

Other fluorescers suitable for use in the invention include the 1-3-diaryl pyrazolines and the 7-alkylaminocoumarins.

Suitable fluorescent brightener levels include lower levels of from about 0.01, from 0.05, from about 0.1 or even from about 0.2 wt % to upper levels of 0.5 or even 0.75 wt %.

FABRIC HUEING AGENTS—dyes or pigments which when formulated in detergent compositions can deposit onto a fabric when said fabric is contacted with a wash liquor comprising said detergent compositions thus altering the tint of said fabric through absorption of visible light. Fluorescent whitening agents emit at least some visible light. In contrast, fabric hueing agents alter the tint of a surface as they absorb at least a portion of the visible light spectrum. Suitable fabric hueing agents include dyes and dye-clay conjugates, and may also include pigments. Suitable dyes include small molecule dyes and polymeric dyes. Suitable small molecule dyes include small molecule dyes selected from the group consisting of dyes falling into the Colour Index (C.I.) classifications of Direct Blue, Direct Red, Direct Violet, Acid Blue, Acid Red, Acid Violet, Basic Blue, Basic Violet and Basic Red, or mixtures thereof, for example as described in WO2005/03274, WO2005/03275, WO2005/03276 and co-pending European application no o6116780.5 filed 7 Jul. 2006.

POLYMERIC DISPERSING AGENTS—The compositions of the present invention can also contain Polymeric dispersing agents. Suitable Polymeric dispersing agents, include polymeric polycarboxylates, substituted (including quarternized and oxidized) polyamine polymers, and polyethylene glycols, such as: acrylic acid-based polymers having an average molecular of about 2,000 to about 10,000; acrylic/maleic-based copolymers having an average molecular weight of about 2,000 to about 100,000 and a ratio of acrylate to maleate segments of from about 30:1 to about 1:1; maleic/acrylic/vinyl alcohol terpolymers; polyethylene glycol (PEG) having a molecular weight of about 500 to about 100,000, preferably from about 1,000 to about 50,000, more preferably from about 1,500 to about 10,000; polyaspartate and polyglutamate; carboxymethylcellulose (CMC) materials; and water soluble or dispersible alkoxylated polyalkyleneamine materials. These polymeric dispersing agents, if included, are typically at levels up to about 5%, preferably from about 0.2% to about 2.5%, more preferably from about 0.5% to about 1.5%.

POLYMERIC SOIL RELEASE AGENT—The compositions of the present invention can also contain Polymeric soil release agent. Polymeric soil release agent, or "SRA", have hydrophilic segments to hydrophilize the surface of hydrophobic fibers such as polyester and nylon, and hydrophobic segments to deposit upon hydrophobic fibers and remain adhered thereto through completion of washing and rinsing cycles, thereby serving as an anchor for the hydrophilic segments. This can enable stains occurring subsequent to treatment with the SRA to be more easily cleaned in later washing procedures. Preferred SRA's include oligomeric terephthalate esters; sulfonated product of a substantially linear ester oligomer comprised of an oligomeric ester backbone of terephthaloyl and oxyalkyleneoxy repeat units and allyl-derived sulfonated terminal moieties covalently attached to the backbone; nonionic end-capped 1,2-propylene/polyoxyethylene terephthalate polyesters; an oligomer having empirical formula $(CAP)_2$ $(EG/PG)_5$ $(T)_5$ $(SIP)_1$ which comprises terephthaloyl (T), sulfoisophthaloyl (SIP), oxyethyleneoxy and oxy-1,2-propylene (EG/PG) units and which is preferably terminated with end-caps (CAP), preferably modified isethionates, as in an oligomer comprising one sulfoisophthaloyl unit, 5 terephthaloyl units, oxyethyleneoxy and oxy-1,2-propyleneoxy units in a defined ratio, preferably about 0.5:1 to about 10:1, and two-end-cap units derived from sodium 2-(2-hydroxyethoxy)-ethanesulfonate; oligomeric esters comprising: (1) a backbone comprising (a) at least one unit selected from the group consisting of dihydroxy sulfonates, polyhydroxy sulfonates, a unit which is at least trifunctional whereby ester linkages are formed resulting in a branched oligomer backbone, and combinations thereof; (b) at least one unit which is a terephthaloyl moiety; and (c) at least one unsulfonated unit which is a 1,2-oxyalkyleneoxy moiety; and (2) one or more capping units selected from nonionic capping units, anionic capping units such as alkoxylated, preferably ethoxylated, isethionates, alkoxylated propanesulfonates, alkoxylated propanedisulfonates, alkoxylated phenolsulfonates, sulfoaroyl derivatives and mixtures thereof. Preferred are esters of the empirical formula:

$$((CAP)_a(EG/PG)_b(DEG)_cPEG)_d(T)_e(SIP)_f(SEG)_g(B)_h)$$

wherein CAP, EG/PG, PEG, T and SIP are as defined hereinabove, DEG represents di(oxyethylene)oxy units, SEG represents units derived from the sulfoethyl ether of glycerin and related moiety units, B represents branching units which are at least trifunctional whereby ester linkages are formed resulting in a branched oligomer backbone, a is from about 1 to about 12, b is from about 0.5 to about 25, c is from 0 to about 12, d is from 0 to about 10, b+c+d totals from about 0.5 to about 25, e is from about 1.5 to about 25, f is from 0 to about 12; e+f totals from about 1.5 to about 25, g is from about 0.05 to about 12; h is from about 0.01 to about 10, and a, b, c, d, e, f, g, and h represent the average number of moles of the corresponding units per mole of the ester; and the ester has a molecular weight ranging from about 500 to about 5,000; and; cellulosic derivatives such as the hydroxyether cellulosic polymers available as METHOCEL® from Dow; the $C_1$-$C_4$ alkyl celluloses and $C_4$ hydroxyalkyl celluloses, see U.S. Pat. No. 4,000,093, issued Dec. 28, 1976 to Nicol et al., and the methyl cellulose ethers having an average degree of substitution (methyl) per anhydroglucose unit from about 1.6 to about 2.3 and a solution viscosity of from about 80 to about 120 centipoise measured at 20° C. as a 2% aqueous solution. Such materials are available as METOLOSE SM100® and METOLOSE SM200®, which are the trade names of methyl cellulose ethers manufactured by Shinetsu Kagaku Kogyo KK.

ENZYMES—The compositions can comprise one or more enzymes which provide cleaning performance and/or fabric care benefits. Examples of suitable enzymes include, but are not limited to, hemicellulases, peroxidases, proteases, other cellulases, xylanases, lipases, phospholipases, esterases, cutinases, pectinases, mannanases, pectate lyases, keratinases, reductases, oxidases, phenoloxidases, lipoxygenases, lignin-nases, pullulanases, tannases, pentosanases, malanases, β-glucanases, arabinosidases, hyaluronidase, chondroitinase, laccase, and amylases, or mixtures thereof. In a preferred embodiment, the compositions of the present invention will further comprise a lipase, for further improved cleaning and whitening performance. A typical combination is an enzyme cocktail that may comprise, for example, a protease and lipase in conjunction with amylase. When present in the detergent composition, the aforementioned enzymes may be present at levels from about 0.00001% to about 2%, from about 0.0001% to about 1% or even from about 0.001% to about 0.5% enzyme protein by weight of the composition.

ENZYME STABILIZERS—Enzymes for use in detergents can be stabilized by various techniques. The enzymes employed herein can be stabilized by the presence of water-soluble sources of calcium and/or magnesium ions in the finished compositions that provide such ions to the enzymes. In case of aqueous compositions comprising protease, a reversible protease inhibitor, such as a boron compound, can be added to further improve stability.

CATALYTIC METAL COMPLEXES—Applicants' detergent compositions may include catalytic metal complexes. One type of metal-containing bleach catalyst is a catalyst system comprising a transition metal cation of defined bleach catalytic activity, such as copper, iron, titanium, ruthenium, tungsten, molybdenum, or manganese cations, an auxiliary metal cation having little or no bleach catalytic activity, such as zinc or aluminum cations, and a sequestrate having defined stability constants for the catalytic and auxiliary metal cations, particularly ethylenediaminetetraacetic acid, ethylenediaminetetra(methylenephosphonic acid) and water-soluble salts thereof. Such catalysts are disclosed in U.S. Pat. No. 4,430,243.

If desired, the compositions herein can be catalyzed by means of a manganese compound. Such compounds and levels of use are well known in the art and include, for example, the manganese-based catalysts disclosed in U.S. Pat. No. 5,576,282.

Cobalt bleach catalysts useful herein are known, and are described, for example, in U.S. Pat. No. 5,597,936; U.S. Pat. No. 5,595,967. Such cobalt catalysts are readily prepared by known procedures, such as taught for example in U.S. Pat. No. 5,597,936, and U.S. Pat. No. 5,595,967.

Compositions herein may also suitably include a transition metal complex of ligands such as bispidones (WO 05/042532 A1) and/or macropolycyclic rigid ligands—abbreviated as "MRLs". As a practical matter, and not by way of limitation, the compositions and processes herein can be adjusted to provide on the order of at least one part per hundred million of the active MRL species in the aqueous washing medium, and will typically provide from about 0.005 ppm to about 25 ppm, from about 0.05 ppm to about 10 ppm, or even from about 0.1 ppm to about 5 ppm, of the MRL in the wash liquor.

Suitable transition-metals in the instant transition-metal bleach catalyst include, for example, manganese, iron and chromium. Suitable MRLs include 5,12-diethyl-1,5,8,12-tetraazabicyclo[6.6.2]hexadecane.

Suitable transition metal MRLs are readily prepared by known procedures, such as taught for example in WO 00/32601, and U.S. Pat. No. 6,225,464.

SOLVENTS—Suitable solvents include water and other solvents such as lipophilic fluids. Examples of suitable lipophilic fluids include siloxanes, other silicones, hydrocarbons, glycol ethers, glycerine derivatives such as glycerine ethers, perfluorinated amines, perfluorinated and hydrofluoroether solvents, low-volatility nonfluorinated organic solvents, diol solvents, other environmentally-friendly solvents and mixtures thereof. The composition may comprise at most 20%, especially at most 5% of water.

SOFTENING SYSTEM—the compositions of the invention may comprise a softening agent such as clay and optionally also with flocculants and enzymes; optionally for softening through the wash.

COLORANT—the compositions of the invention may comprise a colorant, preferably a dye or a pigment. Particularly, preferred dyes are those which are destroyed by oxidation during a laundry wash cycle. To ensure that the dye does not decompose during storage it is preferable for the dye to be stable at temperatures up to 40° C. The stability of the dye in the composition can be increased by ensuring that the water content of the composition is as low as possible. If possible, the dyes or pigments should not bind to or react with textile fibres. If the colorant does react with textile fibres, the colour imparted to the textiles should be destroyed by reaction with the oxidants present in laundry wash liquor. This is to avoid coloration of the textiles, especially over several washes. Particularly, preferred dyes include but are not limited to Basacid® Green 970 from BASF and Monastral blue from Albion.

Detergent Composition

The detergent composition is preferably in granular or powder form, preferably in free-flowing particulate form, although the composition may be in any liquid or solid form. The composition in solid form can be in the form of an agglomerate, granule, flake, extrudate, bar, tablet or any combination thereof. The solid composition can be made by methods such as dry-mixing, agglomerating, compaction, spray drying, pan-granulation, spheronization or any combination thereof. The solid composition preferably has a bulk density of from 300 g/l to 1,500 g/l, preferably from 500 g/l to 1,000 g/l.

The composition may also be in the form of a liquid, gel, paste, dispersion, preferably a colloidal dispersion or any combination thereof. Liquid compositions typically have a viscosity of from 500 cps to 3,000 cps, when measured at a shear rate of 20 $s^{-1}$ at ambient conditions (20° C. and 1 atmosphere), and typically have a density of from 800 g/l to 1300 g/l. If the composition is in the form of a dispersion, then it will typically have a volume average particle size of from 1 micrometer to 5,000 micrometers, preferably from 1 micrometer to 50 micrometers. The particles that form the dispersion are usually the clay and, if present, the silicone. Typically, a Coulter Multisizer is used to measure the volume average particle size of a dispersion.

The composition may in unit dose form, including not only tablets, but also unit dose pouches wherein the composition is at least partially enclosed, preferably completely enclosed, by a film such as a polyvinyl alcohol film.

The composition is preferably a laundry detergent composition although the composition may be used in any cleaning process. The composition may be capable of both cleaning and softening fabric during a laundering process. Typically, the composition is formulated for use in an automatic washing machine or for hand-washing use.

Process of Making Composition

The compositions of the present invention can be formulated into any suitable form and prepared by any process chosen by the formulator, non-limiting examples of which are described in Applicants' examples and in U.S. Pat. No. 4,990,280; U.S. 20030087791A1; U.S. 20030087790A1; U.S. 20050003983A1; U.S. 20040048764A1; U.S. Pat. No. 4,762,636; U.S. Pat. No. 6,291,412; U.S. 20050227891A1; EP 1070115A2; U.S. Pat. No. 5,879,584; U.S. Pat. No. 5,691,297; U.S. Pat. No. 5,574,005; U.S. Pat. No. 5,569,645; U.S. Pat. No. 5,565,422; U.S. Pat. No. 5,516,448; U.S. Pat. No. 5,489,392; U.S. Pat. No. 5,486,303.

Method of Use

The present invention includes a method for laundering a fabric. The method comprises the steps of:

Introducing a composition according to the invention in water in such a proportion that the B:H ratio is at most 0.8 to provide am aqueous laundering composition.

Contacting a fabric to be laundered with said aqueous laundering composition.

The steps may be executed in any order.

The B:H ratio is the molar ratios of builder capacity to hardness.

The fabric may comprise any fabric capable of being laundered in normal consumer use conditions. The solution typically has a pH of from about 7.5 to about 11, preferably from about 8 to about 10.5. The compositions may be employed at concentrations of from about 500 ppm to about 15,000 ppm in solution. The water temperatures typically range from about 5° C. to about 90° C. The water to fabric ratio is typically from about 1:1 to about 30:1.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

The following examples are given by way of illustration only and therefore should not be construed to limit the scope of the invention.

EXAMPLES

In the detergent compositions, the abbreviated component identifications have the following meanings:

AS=alkyl sulphates surfactant

DHLAC=dimethyl hydroxyethyl lauryl ammonium chloride

LAS=Sodium linear $C_{11-13}$ alkylbenzene sulfonate $C_{24}AE_3S$=average $C_{12-14}$ linear alcohol ethoxylate condensed with an average of 3 moles of ethylene oxide per mole of alkyl alcohol CMC=sodium carboxymethyl cellulose TAED=tetraacetylethylenediamine NOBS=nonanoyloxybenzenesulfonate STPP=sodium tripolyphosphate TSPP=trisodium pyrophosphate TSOP=tetrasodium orthophosphate Example 1 to 5

Compositions

| | | Weight (in g) | | | | |
|---|---|---|---|---|---|---|
| | Compound | compostion 1 | compostion 2 | compostion 3 comparative | composition 4 | composition 5 |
| Surfactant | AS | 1.5 | 1.5 | 1.5 | | |
| | KDB-Base | 0.12 | 0.12 | 0.12 | 0.20 | 0.2 |
| | LAS | 13 | 13 | 13 | 12 | 14 |
| | C24AE3S | | | | 1.00 | |
| | Soap | | | | 0.62 | 0.62 |
| Performance enhancer | PhotoBleach | | | | 0.0035 | 0.0035 |
| | Fluorescent whitening agents | | | | 0.06 | 0.06 |
| Polymer | CMC | 0.18 | 0.18 | 0.18 | 0.18 | 0.18 |
| | Polymeric dispersing agents | 1.6 | 1.6 | 1.6 | 1.7 | 4 |
| | EDTA | 0.24 | 0.24 | 0.24 | 0.28 | 0.28 |
| Buffer | $Na_2CO_3$ | 15 | 15 | 15 | 15 | 14 |
| | Sodium silicate | 9.4 | 9.4 | 9.4 | 6.5 | 6.5 |
| Bleach | MgSO4 | | | | 0.49 | 0.49 |
| | Percarbonate | | | | | 5 |
| | PB1 | | | | 3.4 | |
| | TAED | | | | | 5 |
| | NOBS | | | | 1 | |
| | Enzymes | | | | 0.56 | 0.56 |
| Phosphate Builder | total STPP + TSPP + TSOP | 5 | 5 | 5 | 7 | 5 |
| | (STPP + TSPO)/(STTP + TSPP + TSPO) | 1 | 0.5 | 0 | 0.4 | 0.5 |

-continued

| | Compound | Weight (in g) | | | | |
|---|---|---|---|---|---|---|
| | | compostion 1 | compostion 2 | compostion 3 comparative | composition 4 | composition 5 |
| | (STPP)/ (STTP + TSPP + TSPO) | 0 | 0.5 | 1 | n/a | n/a |
| | (TSPP)/ (STTP + TSPP + TSPO) | 1 | 0.5 | 0 | n/a | n/a |
| Filler | $Na_2SO_4$ | bal. to 100 | bal. to 100 | bal. to 100 | bal. to 100 | bal. to 100 |

Composition 1, 2, and 3 have been compared for their sudsing properties in waters comprising respectively 10 gpg of hardness or no hardness.

Compositions of examples 1 and 2 according to the invention provide more suds and increase the suds duration compared to the composition of comparative example 3, even in conditions of no hardness.

Composition of example 1 provides more suds and increases the suds duration compared to composition of example 2, even in conditions of no hardness.

It should be understood that every maximum numerical limitation given throughout this specification includes every lower numerical limitation, as if such lower numerical limitations were expressly written herein. Every minimum numerical limitation given throughout this specification includes every higher numerical limitation, as if such higher numerical limitations were expressly written herein. Every numerical range given throughout this specification includes every narrower numerical range that falls within such broader numerical range, as if such narrower numerical ranges were all expressly written herein.

All parts, ratios, and percentages herein, in the Specification, Examples, and Claims, are by weight and all numerical limits are used with the normal degree of accuracy afforded by the art, unless otherwise specified.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

All documents cited in the DETAILED DESCRIPTION OF THE INVENTION are, in the relevant part, incorporated herein by reference; the citation of any document is not to be construed as an admission that it is prior art with respect to the present invention. To the extent that any meaning or definition of a term or in this written document conflicts with any meaning or definition in a document incorporated by reference, the meaning or definition assigned to the term in this written document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A liquid detergent composition comprising: 2% to 16% by weight, based on the total weight of the liquid detergent composition, of a surfactant system comprising a $C_{12-18}$ alkyl sulfate anionic detersive surfactant and a linear $C_{11-13}$ alkylbenzene sulfonate anionic detersive surfactant;

3% to 6% by weight, based on the total weight of the liquid detergent composition, of detergency builders, the detergency builders comprising at least one aluminosilicate builder and one or more phosphate builders selected from the group consisting of sodium tri-polyphosphate, sodium orthophosphate, sodium pyrophosphate, and mixtures thereof, wherein 60% to 80% by weight of said detergency builders consists of sodium pyrophosphate, the liquid detergent composition having a density of from 800 g/l to 1300 g/l and a viscosity of from 500 cps to 3000 cps when measured at a shear rate of 20 $s^{-1}$ at 20° C. and 1 atm.

2. The liquid detergent composition according to claim 1, further comprising one or more additional builder selected from the group consisting of polycarboxylic acid builders, additional silicate builders, and mixtures thereof, such that said liquid detergent composition comprises a total of at most about 12% by weight of said detergency builders and said one or more additional builder.

3. The liquid detergent composition according to claim 1, further comprising at least one of a polymeric dispersing agent, a polymeric soil release agent, and an enzyme.

4. A method for laundering fabrics comprising at least the steps of:

introducing a liquid detergent composition according to claim 1 in water in such a proportion that the builder to hardness ratio is at most about 0.8 to provide an aqueous laundering composition having a pH of from about 7.5 to about 11 and a concentration of from about 500 ppm liquid detergent composition to about 15,000 ppm liquid detergent composition in said water, and contacting a fabric to be laundered with said aqueous laundering composition.

5. A granular detergent composition comprising:

2% to 16% by weight, based on the total weight of the granular detergent composition, of a surfactant system comprising a $C_{12-18}$ alkyl sulfate anionic detersive surfactant and a linear $C_{11-13}$ alkylbenzene sulfonate anionic detersive surfactant; and 3% to 6% by weight, based on the total weight of the granular detergent composition, of detergency builders, the detergency builders comprising at least one aluminosilicate builder and one or more phosphate builders selected from sodium tri-polyphosphate, sodium orthophosphate, sodium pyrophosphate, and mixtures thereof, wherein 60% to 80% by weight of said detergency builders consists of sodium pyrophosphate, the granular detergent composition having a bulk density of from 300 g/l to 1500 g/l.

6. The granular detergent composition of claim 5, wherein said granular detergent composition has a bulk density of from 500 g/l to 1000 g/l.

7. The granular detergent composition of claim 5, further comprising one or more additional builder selected from the group consisting of polycarboxylic acid builders, additional silicate builders, and mixtures thereof, such that said liquid detergent composition comprises a total of at most about 12% by weight of said detergency builders and said one or more additional builder.

8. The granular detergent composition according to claim 5, further comprising at least one of a polymeric dispersing agent, a polymeric soil release agent, and an enzyme.

* * * * *